US010662832B2

(12) United States Patent
Hirschmann et al.

(10) Patent No.: US 10,662,832 B2
(45) Date of Patent: May 26, 2020

(54) VARIABLE VALVE DRIVE

(71) Applicant: MAN Truck & Bus SE, München (DE)

(72) Inventors: Steffen Hirschmann, Neustadt an der Aisch (DE); Thomas Malischewski, Heilsbronn (DE)

(73) Assignee: MAN TRUCK & BUS SE, München (DE)

( * ) Notice: Subject to any disclaimer, the term of this patent is extended or adjusted under 35 U.S.C. 154(b) by 0 days.

(21) Appl. No.: 16/401,983

(22) Filed: May 2, 2019

(65) Prior Publication Data

US 2019/0338685 A1 Nov. 7, 2019

(30) Foreign Application Priority Data

May 4, 2018 (DE) ..... 10 2018 110 705

(51) Int. Cl.

| | |
|---|---|
| ***F01L 1/34*** | (2006.01) |
| ***F01L 13/06*** | (2006.01) |
| ***F01L 1/344*** | (2006.01) |
| *F01L 13/00* | (2006.01) |

(52) U.S. Cl.

CPC ..... *F01L 13/06* (2013.01); *F01L 1/34413* (2013.01); *F01L 2013/10* (2013.01)

(58) Field of Classification Search

CPC ..... F01L 13/0036; F01L 13/06; F01L 1/181; F01L 1/34413; F01L 2013/0052; F01L 2013/10; F01L 2800/12; F01L 2105/00

See application file for complete search history.

(56) References Cited

U.S. PATENT DOCUMENTS

| | | | | |
|---|---|---|---|---|
| 7,762,225 | B2 * | 7/2010 | Dengler | F01L 1/047 123/90.44 |
| 2010/0126445 | A1 | 5/2010 | Schiepp et al. | |
| 2015/0330270 | A1 | 11/2015 | Noda et al. | |

FOREIGN PATENT DOCUMENTS

| | | | |
|---|---|---|---|
| DE | 19611641 | C1 | 6/1997 |
| DE | 102010033087 | A1 | 2/2012 |
| DE | 102011004912 | A1 | 9/2012 |
| DE | 102011050484 | A1 | 11/2012 |
| DE | 102014019573 | A1 | 6/2016 |

* cited by examiner

*Primary Examiner* — Zelalem Eshete
(74) *Attorney, Agent, or Firm* — Weber Rosselli & Cannon LLP

(57) ABSTRACT

The disclosure relates to a variable valve drive, in particular with a sliding cam system, for an internal combustion engine. The variable valve drive has a cam carrier which has a first and second cam and a first, second, and third engagement track. A first actuator is designed to engage into the first engagement track in order to displace the cam carrier in a first axial direction. A second actuator is designed to engage into the second engagement track in order to displace the cam carrier in a second axial direction which is opposite to the first axial direction, and to engage into the third engagement track in order to displace the cam carrier in the first axial direction. The variable valve drive can have the advantage that, even in the event of a failure of the first actuator, a displacement of the cam carrier that is normally effected by means of the first actuator is possible by means of the second actuator.

20 Claims, 3 Drawing Sheets

VARIABLE VALVE DRIVE

FIELD

The disclosure relates to a variable valve drive, in particular with a sliding cam system, for an internal combustion engine.

BACKGROUND

Valve-controlled internal combustion engines have one or multiple controllable inlet and outlet valves per cylinder. Variable valve drives permit a flexible activation of the valves in order to vary the opening time, closing time and/or the valve lift. In this way, the engine operation can be adapted for example to a specific load situation. For example, a variable valve drive can be realized by means of a so-called sliding cam system.

DE 196 11 641 C1 has disclosed an example of a sliding cam system of the type, by means of which the actuation of a gas exchange valve with multiple different lift curves is made possible. For this purpose, a sliding cam with at least one cam portion which has multiple cam tracks is mounted rotationally conjointly but axially displaceably on the camshaft, which sliding cam has a lift contour into which an actuator in the form of a pin is inserted from radially outside in order to generate an axial displacement of the sliding cam. By means of the axial displacement of the sliding cam, a different valve lift is set at the respective gas exchange valve. The sliding cam, after the axial displacement thereof relative to the camshaft, is thereby locked in its axial relative position on the camshaft.

DE 10 2011 050 484 A1 has disclosed an internal combustion engine with multiple cylinders, a cylinder head and a cylinder head cover. For the actuation of gas exchange valves, at least one rotatably mounted camshaft with at least one sliding cam which is axially displaceable on the respective camshaft is provided. The respective sliding cam has at least one slotted-guide portion with at least one groove. An actuator is provided for effecting an axial displacement of the respective sliding cam. The actuator is mounted in the cylinder head or in the cylinder head cover.

A disadvantage of known systems may be that, in the event of a failure of an actuator, no axial displacement of the sliding cam in accordance with the axial displacement assigned to the failed actuator is possible. Under some circumstances, it is thus no longer possible for the valve timings of the gas exchange valves to be varied. In a particularly adverse situation, it is for example then not possible for a gas exchange valve which is being operated in an engine braking mode by means of the sliding cam system to be switched back to a normal mode.

SUMMARY

The disclosure is based on the object of providing an alternative and/or improved variable valve drive with which, in particular, the stated disadvantages of the prior art can be overcome.

The object is achieved by the features specified in the description.

The disclosure provides a variable valve drive, in particular with a sliding cam system, for an internal combustion engine. The variable valve drive has a shaft and a cam carrier which is arranged rotationally conjointly and axially displaceably on the shaft (for example by means of an axial profiling, in particular to stifle shaft connection or spline connection). The cam carrier has a first cam and a second cam (for example axially offset with respect to the first cam, in particular adjacent to the first cam), a first engagement track, a second engagement track and a third engagement track (for example emergency engagement track and/or fail-safe engagement track). The variable valve drive has a first actuator which is designed to engage (for example by means of a pin of the actuator) into the first engagement track in order to displace the cam carrier in a first axial direction (for example parallel to the longitudinal axis of the shaft and/or of the cam carrier). The variable valve drive has a second actuator, which is designed to engage (for example by means of a pin of the second actuator) into the second engagement track in order to displace the cam carrier in a second axial direction which is opposite to the first axial direction, and to engage (for example by means of the pin of the second actuator) into the third engagement track in order to displace the cam carrier in the first axial direction.

The variable valve drive can have the advantage that, even in the event of a failure of the first actuator, a displacement of the cam carrier that is normally effected by means of the first actuator is possible, specifically by means of the second actuator. For this purpose, the second actuator can engage into the third engagement track. It is thus expediently possible for the third engagement track to serve as an emergency engagement track or fail-safe engagement track. Thus, it can for example be made possible for a switch between an engine braking mode and a normal mode of the internal combustion engine to be possible even in the event of a failure of the first actuator.

In particular, the variable valve drive may have a force transmission device which, in a manner dependent on an axial position of the cam carrier, selectively produces an operative connection between the first cam and a gas exchange valve (for example inlet valve or outlet valve) of the internal combustion engine or between the second cam and gas exchange valve.

It is expediently possible for the first engagement track, the second engagement track and/or the third engagement track to be of helical form at least in certain portions.

For example, the first actuator may have a displaceable pin for engaging into the first engagement track. Alternatively or in addition, the second actuator may have a displaceable pin for selectively engaging into the second engagement track or the third engagement track.

In particular, the shaft and the cam carrier may form a camshaft of the internal combustion engine.

In one exemplary embodiment, an engagement of the first actuator into the first engagement track effects a displacement of the cam carrier from a first axial position (on the shaft) into a second axial position (on the shaft). Alternatively or in addition, an engagement of the second actuator into the third engagement track effects a displacement of the cam carrier from the first axial position into the second axial position. It is possible that an engagement of the second actuator into the second engagement track effects a displacement of the cam carrier from the second axial position into the first axial position.

It is expediently possible for an engine braking mode of the internal combustion engine to be effected in the first axial position and for a normal mode of the internal combustion engine to be effected in the second axial position.

In particular, the first actuator may engage into the first engagement track only if the cam carrier is in the first axial position. Alternatively or in addition, the second actuator may engage into the second engagement track only if the cam carrier is in the second axial position. Alternatively or in addition, the second actuator may engage into the third engagement track only if the cam carrier is in the first axial position.

In a further exemplary embodiment, when the second actuator engages into the third engagement track, an end of a throw-out portion of the third engagement track is reached before the cam carrier reaches the second axial position. Alternatively or in addition, when the second actuator engages into the third engagement track, the cam carrier is accelerated (for example by rotation of the shaft and of the cam carrier) such that the cam carrier, after the throw-out of the second actuator of the third engagement track, moves yet further, in particular in free flight, as far as the second axial position. It is for example possible that a pin of the second actuator is thrown out of the third engagement track (for example by means of a throw-out ramp of the third engagement track) before the cam carrier reaches the second axial position. A relatively short third engagement track is thus made possible.

It is expediently possible for the cam carrier to be lockable in the first axial position and/or the second axial position by means of a locking device.

In one embodiment, the force transmission device, in the first axial position of the cam carrier, produces an operative connection between the second cam and the gas exchange valve, and the second cam is designed as an engine braking cam. Alternatively or in addition, the internal combustion engine, in the first axial position of the cam carrier, is operated in an engine braking mode.

Expediently, the engine braking cam may initially hold an outlet valve (gas exchange valve), which is actuated by the engine braking cam, closed in the compression stroke and/or in the discharge stroke, and then open the outlet valve. In this way, a single or twofold decompression into the exhaust-gas tract can be effected, whereby the internal combustion engine can be braked.

For example, the force transmission device may, in the second axial position of the cam carrier, produce an operative connection between the first cam and the gas exchange valve. The first cam may be designed to effect a normal mode of the gas exchange valve, for example outlet valve (and thus of the internal combustion engine).

In a further embodiment, the variable valve drive has a control unit which is designed to (for example directly or indirectly) activate the first actuator and/or the second actuator.

The expression "control unit" may relate to a set of electronics and/or a mechanical controller, which, depending on the embodiment, can perform open-control tasks and/or closed-loop control tasks. Even where the expression "control" is used herein, this may expediently also encompass "closed-control" or "control with feedback".

For example, the control unit may directly or indirectly activate the first actuator and/or the second actuator. For example, the control unit may activate an actuator directly by electrical energization of an electromagnet or of an electric motor of the electric actuator. It is also possible for the control unit to activate an actuator indirectly by switching a fluid valve or a fluid pump. The fluid valve or the fluid pump is fluidically connected to the actuator (for example hydraulic actuator or pneumatic actuator) in order to control a feed of a fluid to the actuator.

It is expediently possible for the actuators to be designed as electric, pneumatic and/or hydraulic actuators. In the case of for example electric actuators being used, it is possible in particular to realize particularly fast switching times, for example in the single-digit millisecond range. This may be advantageous with regard to the capability for engagement into the third engagement track.

In one design variant, the control unit is designed to (for example directly or indirectly) activate the second actuator to engage into the third engagement track (for example only) if the first actuator and/or an axial displacement by the first actuator exhibits a malfunction. For example, the malfunction may be detected by the control unit. It is thus possible for the third engagement track, as an emergency engagement track or fail-safe engagement track, to be used in particular only if the first actuator is not functioning.

In a further design variant, the control unit is designed to lower an engine rotational speed of the internal combustion engine to below or to, and/or keep an engine rotational speed of the internal combustion engine below or at, a predetermined limit value (for example 1000 rpm, 900 rpm, 800 rpm, 700 rpm, 600 rpm, 550 rpm, 500 rpm) before and/or while the control unit (for example directly or indirectly) activates the second actuator to engage into the third engagement track. Alternatively or in addition, the control unit is designed to lower an engine rotational speed of the internal combustion engine to, and/or keep an engine rotational speed of the internal combustion engine at, an idle rotational speed (for example approximately 600 rpm) before and/or while the control unit (for example directly or indirectly) activates the second actuator to engage into the third engagement track. At the relatively low engine rotational speed, it is in particular the case that relatively low forces act during the displacement process of the cam carrier. In this way, the third engagement track can be dimensioned to be relatively small and/or to have a steep gradient. Furthermore, at low engine rotational speeds, a free flight of the cam carrier at the conclusion of the displacement process can be performed reliably and repeatably.

It is possible that, after a displacement of the cam carrier by engagement of the second actuator into the third engagement track, the control unit permits a higher engine rotational speed again and/or no longer restricts an engine rotational speed.

It is also possible for the control unit to be designed to, after a displacement of the cam carrier by engagement of the second actuator into the third engagement track, prevent another backward displacement by engagement of the second actuator into the second engagement track.

In a further design variant, the control unit is designed to (for example directly or indirectly) activate the second actuator in multiple successive attempts (for example two times, three times, four times etc.) to engage into the third engagement track until such time as the cam carrier has been displaced into the second axial position.

In a further exemplary embodiment, the control unit is designed to, in the event of a malfunction of the first actuator, prevent an axial displacement of the cam carrier by engagement of the second actuator into the second engagement track.

In a further exemplary embodiment, a length, in particular an arc length, of the third engagement track is shorter than a length, in particular an arc length, of the first engagement track and/or a length, in particular an arc length, of the second engagement track. Alternatively or in addition, a length, in particular an arc length, of the third engagement track lies in a range of less than or equal to 90° camshaft angle (for example less than or equal to 60° camshaft angle) and/or greater than or equal to 20° camshaft angle (for example greater than or equal to 30° camshaft angle). The camshaft angle ranges may differ for example depending on use, cam size etc.

For example, the length of the third engagement track may be less than or equal to one half of the length of the first engagement track and/or of the second engagement track.

In one embodiment, a depth (for example maximum depth) of the third engagement track is smaller than a depth (for example maximum depth) of the first engagement track and/or a depth of the second engagement track. Alternatively or in addition, a depth (for example maximum depth) of the third engagement track lies in a range of less than or equal to 2 mm and/or greater than or equal to 1 mm. The depth may differ for example depending on use, cam size etc.

For example, the depth of the third engagement track may be less than or equal to one half of the depth of the first engagement track and/or of the second engagement track.

In a further embodiment, a gradient of the third engagement track is steeper than a gradient of the first engagement track and/or a gradient of the second engagement track. Alternatively or in addition, an axial extent of the third engagement track along an axial axis of the cam carrier is shorter than an axial extent of the first engagement track along the axial axis of the cam carrier and/or an axial extent of the second engagement track along the axial axis of the cam carrier. It is possible for the third engagement track to be dimensioned to be smaller than the first engagement track and/or the second engagement track.

The smaller dimensioning of the third engagement track in relation to the first and second engagement track can allow for the use thereof as an emergency engagement track. The smaller dimensioning may be made possible in that the displacement of the cam carrier during engagement into the third engagement track is performed at a predetermined low engine rotational speed at which relatively low forces act.

In one exemplary embodiment, a start of a run-in portion, in particular of a run-in ramp, of the third engagement track adjoins an end of a throw-out portion, in particular of a throw-out ramp, of the second engagement track, in particular in a circumferential direction around the cam carrier (for example with a small spacing in the single-digit camshaft angle range).

In a further exemplary embodiment, the cam carrier has a force engagement track, and the first actuator is designed to engage into the fourth engagement track in order to displace the cam carrier in the second axial direction. Alternatively or in addition, an engagement of the first actuator into the fourth engagement track effects a displacement of the cam carrier from the second axial position of the cam carrier into a first axial position of the cam carrier.

It is expediently possible for the features described herein that relate to the third engagement track to likewise be realized in the case of the fourth engagement track.

It is expediently possible for the cam carrier, the shaft and the actuator device to form a sliding cam system.

The disclosure also relates to a motor vehicle, in particular a utility vehicle (for example heavy goods vehicle or bus) having a variable valve drive as disclosed herein.

It is also possible to use the device as disclosed herein for passenger motor vehicles, large engines, off-road vehicles, static engines, marine engines, etc.

BRIEF DESCRIPTION OF THE DRAWINGS

The above-described embodiments and features of the disclosure may be combined with one another in any desired manner. Further details and advantages of the disclosure will be described below with reference to the appended drawings. In the drawings.

The embodiments shown in the figures at least partially correspond, and therefore similar or identical parts are denoted with the same reference designations, and for the explanation of the parts, reference is also made to the description of the other embodiments or figures in order to avoid repetitions.

DETAILED DESCRIPTION

Figure 1:
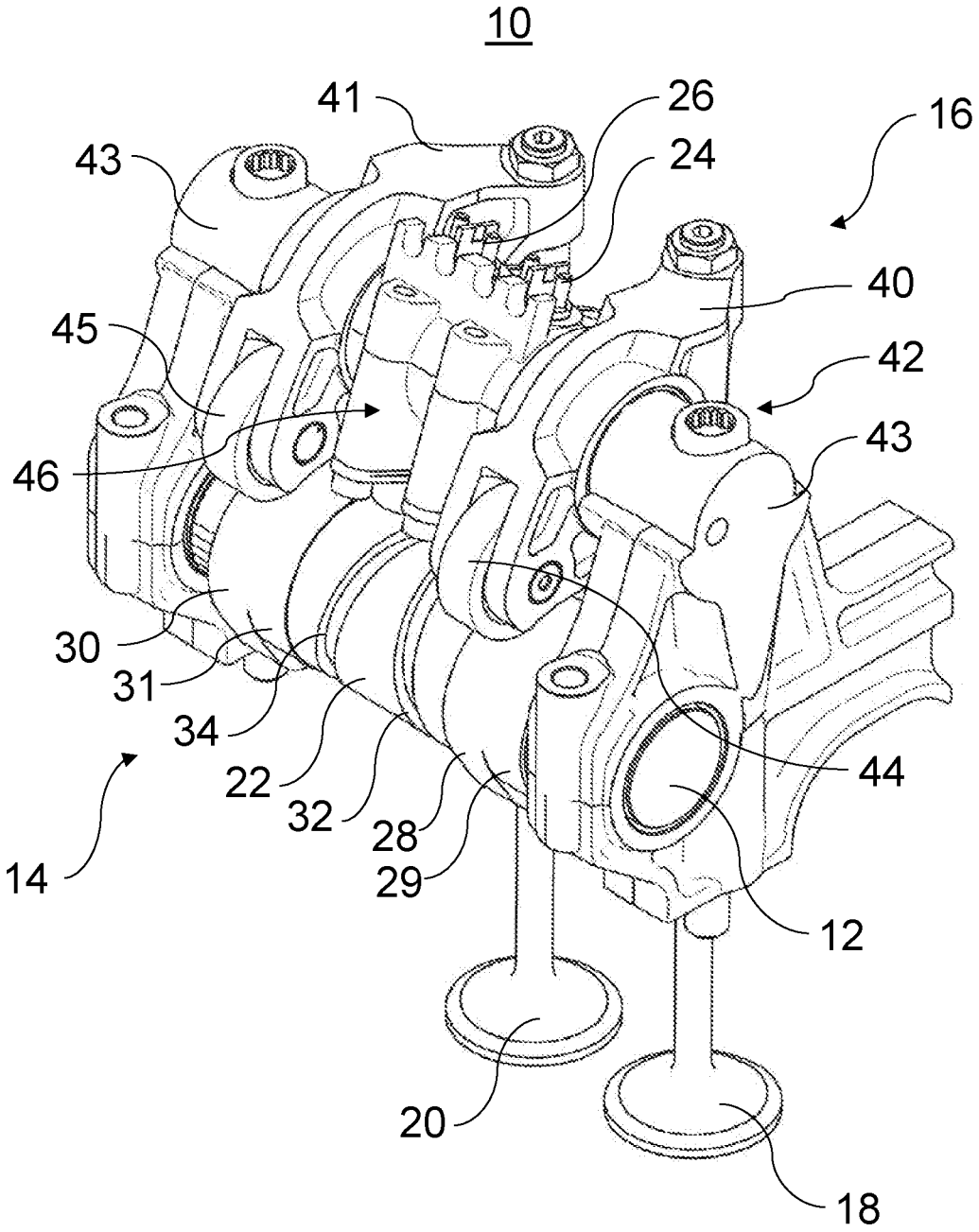
FIG. 1 shows an isometric view of an exemplary variable valve drive according to the present disclosure.
Figure 2:
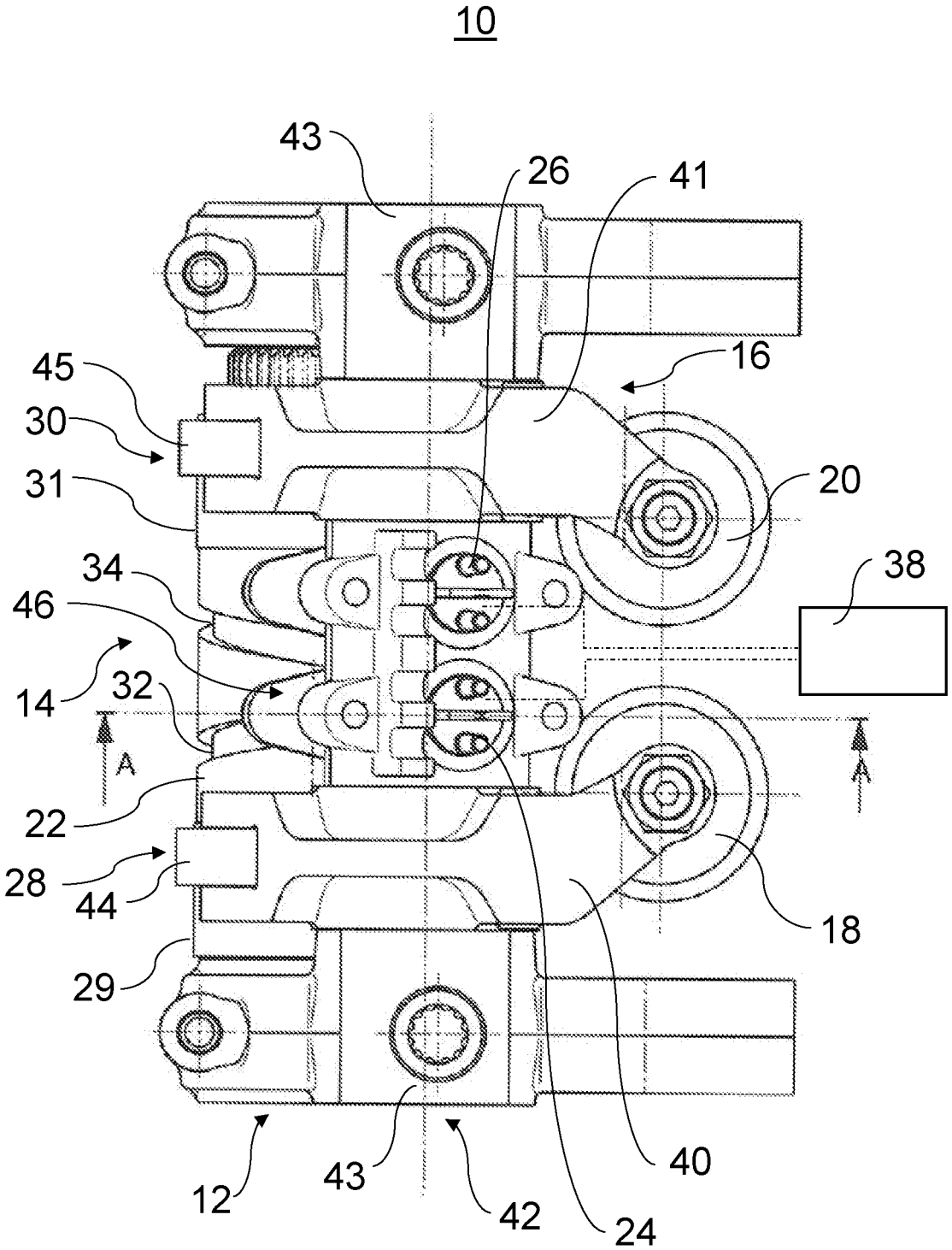
FIG. 2 shows a plan view, or a view from above, of the exemplary variable valve drive.

FIGS. 1 and 2 show a variable valve drive 10. The variable valve drive 10 has a shaft (camshaft) 12, a sliding cam system 14, a force transmission device 16, a first gas exchange valve 18 and a second gas exchange valve 20. The gas exchange valves 18, 20 may for example be inlet valves or outlet valves of a cylinder of an internal combustion engine.

The variable valve drive 10 may be used for adapting the valve control curves of the first and second gas exchange valves 18, 20. The variable valve drive 10 is assigned to an internal combustion engine (not illustrated). The internal combustion engine may for example be part of a utility vehicle, for example a bus or a heavy goods vehicle. The internal combustion engine may have one or more cylinders.

The sliding cam system 14 has a cam carrier 22 and an actuator device with a first actuator 24 and a second actuator 26.

The cam carrier 22 is arranged rotationally conjointly and axially displaceably on the shaft 12, for example by means of an axial profiling of the outer circumference of the shaft 12 and of the inner circumference of the cam carrier 22 (for example toothed shaft connection or spline connection). It is possible for multiple cam carriers 22 to be able to be arranged on the shaft 12, for example in order to actuate gas exchange valves of multiple cylinders of the internal combustion engine. The cam carrier 22 has four cams 28-31, a first engagement track (switching slotted guide) 32, a second engagement track (switching slotted guide) 34 and a third engagement track 36 (see FIG. 3, not visible in FIGS. 1 and 2). As described in detail elsewhere herein, the third engagement track 36 serves in particular as an emergency engagement track in the event that the first actuator 24 fails.

The cam carrier 22 forms, together with the shaft 12, a camshaft. The shaft 12 with the cam carrier 22 is arranged as an overhead camshaft (OHC). The shaft 12 with the cam carrier 22 may be provided as part of a double camshaft system (double overhead camshaft—DOHC) or as a single camshaft (single overhead camshaft—SOHC).

The four cams 28-31 may have different cam contours in order to generate different valve control curves for the gas exchange valves 18, 20. The cams 28-31 may at least partially also be formed as zero-lift cams. The different cam contours of the cams 28-31 be used for example for reducing fuel consumption, for thermal management or for realizing an engine brake. In the exemplary embodiment described here, the second cam 29 is designed as an engine braking cam. An engine braking function by means of the engine braking cam may be realized for example by virtue of an outlet valve actuated by the engine braking cam initially being held closed in the compression stroke and/or in the discharge stroke, and then being opened. In this way, a (twofold) decompression into the exhaust-gas tract is effected, which brakes the internal combustion engine. The associated cylinder is not fired. Furthermore, the fourth cam 31 may for example be designed as a zero-lift cam.

The four cams 28-31 are arranged offset with respect to one another along a longitudinal axis of the cam carrier 22. The first cam 28 is arranged adjacent to the second cam 29. The third cam 30 is arranged adjacent to the fourth cam 31. The first and second cams 28, 29 serve selectively for the actuation of the first gas exchange valve 18. The third and fourth cams 30, 31 serve selectively for the actuation of the second gas exchange valve 20. The cams 28, 29 and 30, 31 are arranged at opposite ends of the cam carrier 22. In other embodiments, it is possible for additional cams, fewer cams and/or alternative arrangements of the cams to be provided, for example a central arrangement of the cams on the cam carrier.

The actuators 24, 26 may be electrically (for example electromotively, electromagnetically), pneumatically and/or hydraulically actuated. In the embodiment illustrated, the actuators are electrically actuated (see the electrical terminals at the upper ends thereof).

The sliding cam system 14 may additionally have a locking device (not illustrated). The locking device may be designed so as to secure the cam carrier 22 axially on the shaft 12 in the desired axial positions. For this purpose, the locking device may for example have an elastically preloaded blocking body. The blocking body may, in a first axial position of the cam carrier 22, engage into a first recess of the cam carrier 22 and, in a second axial position of the cam carrier 22, engage into a second recess of the cam carrier 22. The locking device may for example be provided in the shaft 12.

The force transmission device 16 has a first force transmission element 40, a second force transmission element 41, a lever axle 42 and a multiplicity of bearing blocks 43. The force transmission elements 40, 41 are arranged rotatably on the lever axle 42 so as to be pivotable about the lever axle 42. The lever axle 42 is mounted or held in the bearing blocks 43. The shaft 12 is mounted rotatably in the bearing blocks 43. It is for example also possible for separate bearing blocks to be provided for the lever axle 42 and the shaft 12. The actuators 24 and 26 are carried on the lever axle 42 by a carrying device 46.

In the embodiment shown, the force transmission elements 40, 41 are formed as rocker levers, and the lever axle 42 is thus formed as a rocker lever axle. It is however for example also possible for the force transmission elements 40, 41 to be formed as valve levers, and for the lever axle 42 to thus be formed as a valve lever axle.

In the embodiment illustrated, the first force transmission element 40 serves for actuating the first gas exchange valve 18, and the second force transmission element 41 serves for actuating the second gas exchange valve 20. It is however also possible, for example, for multiple gas exchange valves to be actuated by means of only one force transmission element, for example with the interposition of a valve bridge.

The force transmission elements 40, 41 have in each case one cam follower 44, 45, for example in the form of a rotatably mounted roller. The cam followers 44, 45 follow a cam contour of the cams 28-31 in a manner dependent on an axial position of the cam carrier 22.

Figure 3:
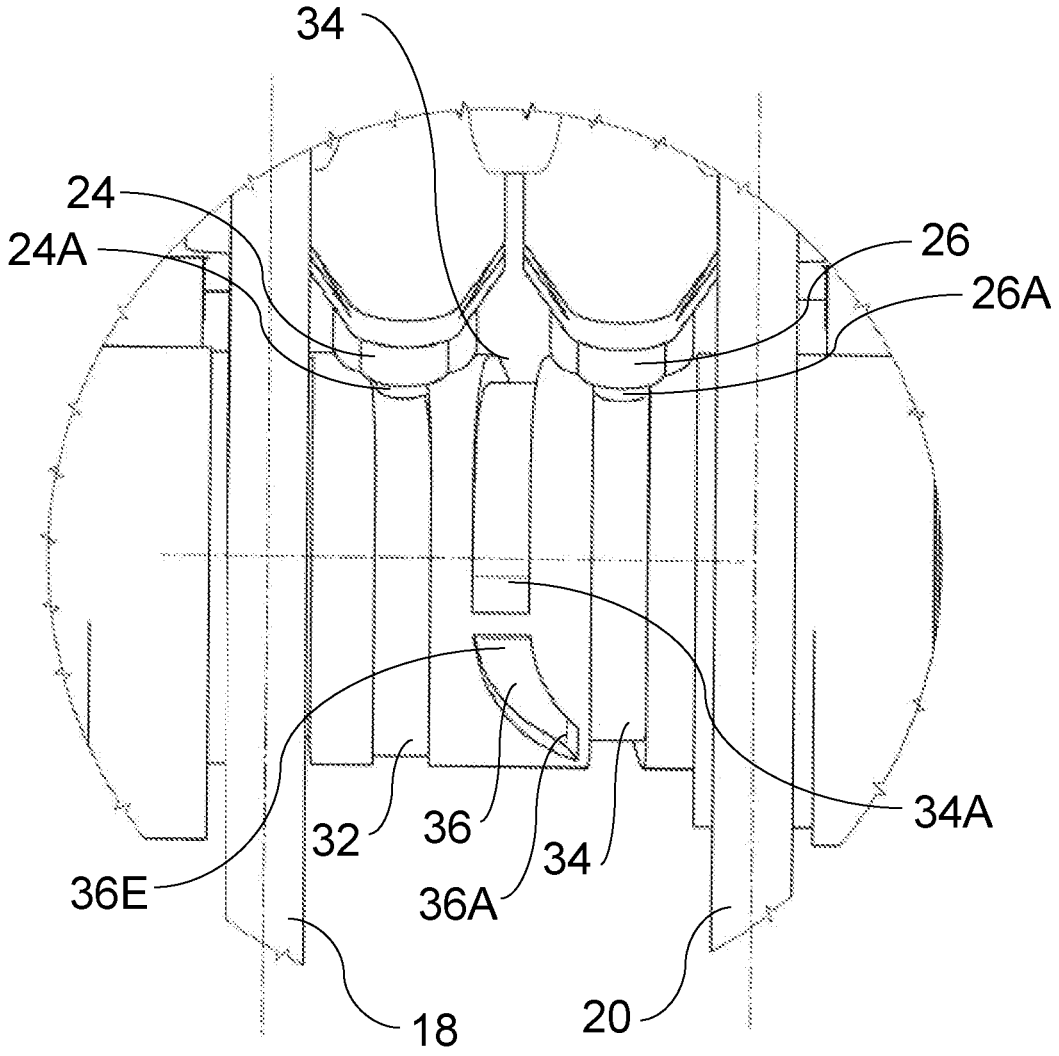
FIG. 3 shows a detail illustration of a portion of a cam carrier of the exemplary variable valve drive.

Referring to FIGS. 1 to 3, the functioning of the actuators 24, 26 in interaction with the engagement tracks 32, 34 and 36 will be described below.

The first engagement track 32, the second engagement track 34 and the third engagement track 36 (visible only in FIG. 3) are provided centrally on the cam carrier 22. It is also possible for the engagement tracks to be arranged eccentrically, for example at the ends on the cam carrier. Engagement tracks 32, 34 and 36 extend helically as depressions (grooves or slotted guides) in the cam carrier 22 about a longitudinal axis of the shaft 12.

For the axial displacement of the cam carrier 22, it is possible for pins 24A, 26A (see FIG. 3), which are displaceable radially with respect to the longitudinal axis of the shaft 12, of the actuators 24, 26 to engage selectively into the engagement tracks 32, 34, 36. In detail, a pin 24A of the first actuator 24 can engage selectively into the first engagement track 32 in order to displace the cam carrier 22 from a first axial position to a second axial position. FIGS. 1 to 3 illustrate the cam carrier 22 in the second axial position by way of example. The pin 24A of the first actuator 24 can only engage into the first engagement track 32 for the displacement into the second axial position if the cam carrier 22 is in the first axial position.

The pin 26A of the second actuator 26 can in turn engage selectively into the second engagement track 34 if the cam carrier 22 is in the second axial position. Then, the cam carrier 22 is displaced from the second axial position back to the first axial position (to the right in FIG. 3).

In the second axial position, illustrated in FIGS. 1-3, of the cam carrier 22, the gas exchange valves 18, 20 are actuated by the first cam 28 and the third cam 30. Specifically, the first gas exchange valve 18 is actuated by the first cam 28 and the second gas exchange valve 20 is actuated by the third cam 30.

In the first axial position of the cam carrier 22, the gas exchange valves 18, 20 are actuated by the second cam 29 and the fourth cam 31. Specifically, the first gas exchange valve 18 is actuated by the second cam 29 and the second gas exchange valve 20 is actuated by the fourth cam 31.

As already mentioned, the second cam 29 may be designed as an engine braking cam, and the fourth cam 31 may be designed as a zero-lift cam. Thus, in the first axial position of the cam carrier 22, an engine braking mode of the internal combustion engine can be effected. By contrast to this, in the second axial position of the cam carrier 22, a normal mode of the internal combustion engine can for example be effected.

The axial displacement of the cam carrier 22 is triggered by virtue of the fact that the deployed pin 24A, 26A of the respective actuator 24, 26 is positionally fixed with respect to an axial direction of the shaft 12. Consequently, the displaceable cam carrier 22 is, owing to the helical form of the engagement tracks 32, 34, displaced in a longitudinal direction of the shaft 12 if one of the deployed pins 24A, 26A engages into the respective engagement track 32, 34. At the end of the axial displacement process, the deployed pin 24A, 26A of the respective actuator 24, 26 is guided by the respective engagement track 32, 34 via a pushing-out ramp oppositely to the deployment direction and is thus retracted or thrown out. The pin 24A, 26A of the respective actuator 24, 26 passes out of engagement with the respective engagement track 32, 34.

For as long as the actuators 24 and 26 are functional, it is possible for switching between the first axial position and the second axial position of the cam carrier 22 to be performed as desired. It is thus for example possible for an engine braking mode to be realized in the first axial position and for a normal mode of the gas exchange valves 18, 20 to be realized in the second axial position.

It is however conceivably possible for the first actuator 24 to fail. As a consequence, it is no longer possible by means of the first actuator 24 to perform a switch from the first axial position of the cam carrier 22 for the engine braking mode to the second axial position of the cam carrier 22 for the normal mode. To nevertheless permit an axial displacement of the cam carrier 22 from the first axial position to the second axial position, the third engagement track 36 for the second actuator 26 is provided. In particular in the event of a malfunction of the first actuator 24, it is thus nevertheless still possible to switch to the normal mode by means of the second actuator 26.

The third engagement track 36 is designed as an emergency engagement track which is expediently utilized by the second actuator 26 only if the first actuator 24 fails. This may be detected for example by means of a control unit 38 which is schematically illustrated in FIG. 2. The control unit 38 may have a communication connection to the first actuator 24 and to the second actuator 26, and for example to one or more further components of the internal combustion engine, in particular for the closed-loop control of a rotational speed of the internal combustion engine. It is possible for the control unit 38 to directly or indirectly activate the first actuator 24 and/or the second actuator 26.

The third engagement track 36 may at least partially likewise extend helically. The third engagement track 36 may in particular be shallower (less deep) and shorter (less long) than the engagement tracks 32, 34. For example, an arc length of the third engagement track may lie in a range between 20° camshaft angle and 90° camshaft angle, for example between 30° camshaft angle and 60° camshaft angle, whereas an arc length of the engagement tracks 32, 34 may be greater, for example between 120° camshaft angle and 160° camshaft angle. It is possible for a depth of the third engagement track 36 to lie in a range between 2 mm and 3 mm, whereas a depth of the engagement tracks 32, 34 may be greater, for example 3 mm to 6 mm, in particular approximately 4.5 mm. Furthermore, the third engagement track 36 may have a steeper gradient than the engagement tracks 32, 34.

The third engagement track 36 is thus designed to permit a switch from the first axial position into the second axial position in a relatively small range, in particular in relation to the engagement tracks 32, 34. It must be taken into consideration here that the engagement tracks 32, 34 and 36 are expedient positioned only in the base circle range of the cams 28-31, because a switch between the cams 28-31 can be possible only here. The geometrical adaptations of the third engagement track 36 in relation to the engagement tracks 32, 34 are made possible by virtue of the fact that it is in particular used only as an emergency engagement track. The emergency switch may take place at a relatively low, predetermined engine rotational speed (and thus camshaft rotational speed). Here, relatively low forces act during the displacement of the cam carrier 22.

If the control unit 38 detects for example that the first actuator 24 has a malfunction and a switch from the first axial position back into the second axial position is desired, the control unit 38 can lower the engine rotational speed to a predetermined rotational speed, for example an idle rotational speed for example around 600 rpm. After the pin 26A of the second actuator 26 has crossed or passed a run-out portion (for example run-out ramp or throw-out ramp) 34A of the second engagement track 34 without being actuated, the second actuator 26 is activated, for example electrically energized, by the control unit 38. The pin 26A of the second actuator 26 then runs into the run-in portion or the run-in ramp 36E of the third engagement track 36, which adjoins the run-out portion 34A of the second engagement track 34 with a small spacing or in the single-digit camshaft angle range (see FIG. 3). Owing to the low rotational speed of the shaft 12, sufficient time remains for the engagement into the third engagement track 36.

The pin 26A of the second actuator 26 then effects a displacement of the cam carrier 22 from the first axial position in the direction of the second axial position. Here, the pin 26A may be thrown out of the third engagement track 36, by means of a throw-out portion or run-out portion 36A of the third engagement track 36, already before the cam carrier 22 actually reaches the second axial position. After the throw-out of the pin 26A, the cam carrier 22 moves, as it were, in defined free flight as far as the second axial position, in which it is locked by means of the locking device (not illustrated). The cam carrier 22 is thus accelerated by means of engagement of the pin 26A into the third engagement track 36, such that the cam carrier can reach the second axial position in free flight. At the same time, the acceleration may be selected such that the cam carrier 22 does not impact overly intensely against the corresponding axial stop of the second axial position, in order to prevent an overly intense rebound with the consequence of locking in the second axial position not being possible.

It is possible for the control unit 38 to perform multiple attempts until the cam carrier 22 is, by engagement of the pin 26A into the third engagement track 36, actually moved into the second axial position and expediently locked therein.

After a displacement of the cam carrier 22 by means of engagement into the third engagement track 36, the control unit 38 can permit a higher engine rotation speed again. Alternatively or in addition, the controller 38 may expediently prevent the cam carrier 22 from being displaced into the first axial position again by means of the second actuator 26.

It is for example also possible for a fourth engagement track (not illustrated in the figures) to be provided in the cam carrier 22, by means of which fourth engagement track the first actuator 24 can, for example in the event of a malfunction of the second actuator 26, effect an axial displacement of the cam carrier 22 from the second axial position into the first axial position. The fourth engagement track may be designed and used analogously to the third engagement track 36.

The disclosure is not restricted to the exemplary embodiments described above. In fact, numerous variants and modifications are possible which likewise make use of the concept of the disclosure and thus fall within the scope of protection.

LIST OF REFERENCE DESIGNATIONS

10 Variable valve drive
12 Shaft
14 Sliding cam system
16 Force transmission device
18 First gas exchange valve
20 Second gas exchange valve
22 Cam carrier
24 First actuator
24A Pin
26 Second actuator
26A Pin
28 First cam
29 Second cam
30 Third cam
31 Fourth cam
32 First engagement track

34 Second engagement track
34A Run-out portion
36 Third engagement track
36A Run-out portion
36E Run-in portion
38 Control unit
40 First force transmission element
41 Second force transmission element
42 Lever axle
43 Bearing block
44 Cam follower
45 Cam follower
46 Carrying device

The invention claimed is:

1. A variable valve drive comprising:

a shaft;

a cam carrier which is arranged rotationally conjointly and axially displaceably on the shaft and which has a first cam, a second cam, a first engagement track, a second engagement track, and a third engagement track;

a first actuator which is designed to engage into the first engagement track in order to displace the cam carrier in a first axial direction; and a second actuator which is designed to engage into the second engagement track in order to displace the cam carrier in a second axial direction which is opposite to the first axial direction, and to engage into the third engagement track in order to displace the cam carrier in the first axial direction.

2. The variable valve drive according to claim 1, wherein:

an engagement of the first actuator into the first engagement track effects a displacement of the cam carrier from a first axial position into a second axial position; and an engagement of the second actuator into the third engagement track effects a displacement of the cam carrier from the first axial position into the second axial position or an engagement of the second actuator into the second engagement track effects a displacement of the cam carrier from the second axial position into the first axial position.

3. The variable valve drive according to claim 2, further comprising:

a force transmission device that, in the first axial position of the cam carrier, produces an operative connection between the second cam and a gas exchange valve, wherein the second cam is designed as an engine braking cam, or an internal combustion engine that, in the first axial position of the cam carrier, is operated in an engine braking mode.

4. The variable valve drive according to claim 1, wherein:

when the second actuator engages into the third engagement track, an end of a throw-out portion of the third engagement track is reached before the cam carrier reaches a second axial position; or when the second actuator engages into the third engagement track, the cam carrier is accelerated such that the cam carrier, after the throw-out of the second actuator of the third engagement track, moves yet further in free flight as far as the second axial position; or a pin of the second actuator is thrown out of the third engagement track before the cam carrier reaches the second axial position.

5. The variable valve drive according to claim 1, further comprising a control unit which is designed to activate the first actuator or the second actuator.

6. The variable valve drive according to claim 5, wherein the control unit is designed to activate the second actuator to engage into the third engagement track if the first actuator or an axial displacement by the first actuator exhibits a malfunction.

7. The variable valve drive according to claim 5, wherein:

the control unit is designed to lower an engine rotational speed of an internal combustion engine to below or to, and/or keep an engine rotational speed of the internal combustion engine below or at, a predetermined limit value before or while the control unit activates the second actuator to engage into the third engagement track; or the control unit is designed to lower an engine rotational speed of the internal combustion engine to, or keep an engine rotational speed of the internal combustion engine at, an idle rotational speed before or while the control unit activates the second actuator to engage into the third engagement track.

8. The variable valve drive according to claim 5, wherein the control unit is designed to activate the second actuator in multiple successive attempts to engage into the third engagement track until such time as the cam carrier has been displaced into a second axial position.

9. The variable valve drive according to claim 5, wherein the control unit is designed to, in an event of a malfunction of the first actuator, prevent an axial displacement of the cam carrier by engagement of the second actuator into the second engagement track.

10. The variable valve drive according to claim 1, wherein an arc length of the third engagement track is shorter than an arc length of the first engagement track or an arc length of the second engagement track.

11. The variable valve drive according to claim 1, wherein an arc length of the third engagement track lies in a range of less than or equal to 90° camshaft angle or greater than or equal to 20° camshaft angle.

12. The variable valve drive according to claim 1, wherein a depth of the third engagement track is smaller than a depth of the first engagement track or a depth of the second engagement track.

13. The variable valve drive according to claim 1, wherein a depth of the third engagement track lies in a range of less than or equal to 2 mm and/or greater than or equal to 1 mm.

14. The variable valve drive according to claim 1, wherein a gradient of the third engagement track is steeper than a gradient of the first engagement track or a gradient of the second engagement track.

15. The variable valve drive according to claim 1, wherein an axial extent of the third engagement track along an axial axis of the cam carrier is shorter than an axial extent of the first engagement track along the axial axis of the cam carrier or an axial extent of the second engagement track along the axial axis of the cam carrier.

16. The variable valve drive according to claim 1, wherein the third engagement track is dimensioned to be smaller than the first engagement track or the second engagement track.

17. The variable valve drive according to claim 1, wherein a start of a run-in portion of the third engagement track adjoins an end of a throw-out portion of the second engagement track.

18. The variable valve drive according to claim 1, wherein a start of a run-in ramp of the third engagement track adjoins an end of a throw-out ramp of the second engagement track in a circumferential direction around the cam carrier.

19. The variable valve drive according to claim 1, wherein:

the cam carrier has a fourth engagement track; and the first actuator is designed to engage into the fourth engagement track in order to displace the cam carrier in the second axial direction, or an engagement of the first actuator into the fourth engagement track effects a displacement of the cam carrier from a second axial position of the cam carrier into a first axial position of the cam carrier.

20. A motor vehicle or a utility vehicle comprising a variable valve drive according to claim 1.

* * * * *